US010197070B2

(12) United States Patent
Stephan et al.

(10) Patent No.: US 10,197,070 B2
(45) Date of Patent: Feb. 5, 2019

(54) DIFFUSOR, VENTILATOR HAVING SUCH A DIFFUSOR, AND DEVICE HAVING SUCH VENTILATORS

(71) Applicant: Ziehl-Abegg AG, Künzelsau (DE)

(72) Inventors: Michael Stephan, Bretzfeld-Waldbach (DE); Frieder Lörcher, Braunsbach (DE); Daniel Seifried, Schwäbisch Hall (DE)

(73) Assignee: Zieh1-Abegg SE, Künzelsau (DE)

( * ) Notice: Subject to any disclaimer, the term of this patent is extended or adjusted under 35 U.S.C. 154(b) by 1146 days.

(21) Appl. No.: 14/379,292

(22) PCT Filed: Feb. 15, 2013

(86) PCT No.: PCT/EP2013/000453

§ 371 (c)(1),
(2) Date: Aug. 16, 2014

(87) PCT Pub. No.: WO2013/120623

PCT Pub. Date: Aug. 22, 2013

(65) Prior Publication Data

US 2015/0300372 A1 Oct. 22, 2015

(30) Foreign Application Priority Data

Feb. 17, 2012 (DE) ..... 10 2012 003 336

(51) Int. Cl.

| | |
|---|---|
| ***F04D 29/54*** | (2006.01) |
| ***F04D 19/00*** | (2006.01) |
| ***F04D 25/16*** | (2006.01) |

(52) U.S. Cl.
CPC ..... *F04D 29/547* (2013.01); *F04D 19/002* (2013.01); *F04D 25/166* (2013.01); *F04D 29/545* (2013.01)

(58) Field of Classification Search
CPC .... F04D 25/166; F04D 29/545; F04D 29/547; F24F 13/06; F24F 13/0612; F24F 13/062
USPC ..... 415/211.2, 219.1; 454/299, 300, 354
See application file for complete search history.

(56) References Cited

U.S. PATENT DOCUMENTS

| | | | | |
|---|---|---|---|---|
| 1,940,790 A | | 12/1933 | Diehl | |
| 2,144,035 A | | 1/1939 | Smith, Jr. | |
| 2,750,865 A | * | 6/1956 | Tutt | F24F 13/062 454/262 |

(Continued)

FOREIGN PATENT DOCUMENTS

| | | |
|---|---|---|
| DE | 35 15 441 A1 | 10/1986 |
| DE | 20 2011 004 708 U1 | 9/2011 |

(Continued)

*Primary Examiner* — Carlos A Rivera
*Assistant Examiner* — Sang K Kim
(74) *Attorney, Agent, or Firm* — Gudrun E. Huckett

(57) ABSTRACT

The invention relates to a diffusor having a wall (8) that encloses an inlet having a round cross-section that transitions into an angular cross-section on the outlet of the diffusor over the height of the wall (8) of the diffusor. The transitions (15) between the sides (34 to 37) of the wall (8) have a twist in the height direction that follows the twirl of the flow of air through the diffusor. The ventilator has such a diffusor. The device has a housing on which at least two ventilators, each having one diffusor, are arranged.

23 Claims, 11 Drawing Sheets

(56) References Cited

U.S. PATENT DOCUMENTS

| | | | | | |
|---|---|---|---|---|---|
| 4,714,009 | A * | 12/1987 | DeHart | F24F 13/062 | 454/300 |
| 4,767,262 | A * | 8/1988 | Simon | H05K 7/20581 | 165/122 |
| 5,117,745 | A * | 6/1992 | Prochnow | F24F 13/062 | 24/295 |
| 5,342,173 | A | 8/1994 | Vera | | |
| 5,462,088 | A | 10/1995 | Poux et al. | | |
| 5,740,766 | A * | 4/1998 | Moser | F01P 5/06 | 123/41.49 |
| 5,791,876 | A * | 8/1998 | Moser | F04D 25/02 | 416/169 A |
| 6,193,603 | B1 * | 2/2001 | Tai | F24F 13/085 | 454/300 |
| 6,676,371 | B1 * | 1/2004 | Brown | F04D 29/023 | 123/41.49 |
| 6,776,710 | B1 | 8/2004 | Messmer et al. | | |
| 2009/0162195 | A1 * | 6/2009 | Nelson | F04D 29/526 | 415/219.1 |
| 2011/0217164 | A1 * | 9/2011 | Cote | F04D 29/526 | 415/223 |
| 2014/0086728 | A1 * | 3/2014 | Engert | F04D 29/547 | 415/119 |

FOREIGN PATENT DOCUMENTS

| | | | | |
|---|---|---|---|---|
| DE | 202010016820 U1 * | 3/2012 | | F04D 29/547 |
| FR | 2 728 028 | 6/1996 | | |
| FR | 2 874 409 A1 | 2/2006 | | |
| GB | 788 581 | 1/1958 | | |
| JP | H09-229423 | 9/1997 | | |
| JP | 2007-040562 | 2/2007 | | |
| WO | 2010/010277 | 1/2010 | | |
| WO | 2011/153921 A1 | 12/2011 | | |

* cited by examiner

DIFFUSOR, VENTILATOR HAVING SUCH A DIFFUSOR, AND DEVICE HAVING SUCH VENTILATORS

BACKGROUND OF THE INVENTION

The invention concerns a diffusor with at least one wall which surrounds an inlet round cross-section that, across the height of the wall of the diffusor, passes into an angular cross-section at the outlet of the diffusor. The invention further concerns a ventilator with an impeller and a diffusor that is in particular embodied as described above. The invention further concerns a device with such ventilators.

FIG. 12 shows a freestanding device according to the prior art (DE 35 15 441) that is provided with a housing. On its topside, ventilators, mounted on heat exchangers, are provided. The ventilators blow out air unhindered so that the entire dynamic energy is lost at the ventilator exit.

In order to reduce the considerable flow losses at the exit of pipe conduits, ventilators and the like, exit diffusors are used (DE 20 2011 004 708 U1, FR 27 28 028). On devices, for example, tabletop coolers, there is however only a limited space available in radial direction. Since the exit diffusors have a circular cross-section, the ventilators with the exit diffusors cannot be arranged tightly adjacent to each other. This is however often required for such devices where the ventilators must be arranged also in multiple rows tightly adjacent to each other. Therefore, a lot of space is lost on a device with several ventilators. Thus, local dead water zones which lead to increasing losses are also formed between the diffusors.

The invention has the object to design the diffusor of the aforementioned kind as well as the ventilator of the aforementioned kind such that the space on the devices can be optimally utilized without a constructively complex configuration being required for this purpose.

SUMMARY OF THE INVENTION

This object is solved for the diffusor of the aforementioned kind in accordance with the invention in that the transitions between the sides of the wall in the vertical direction have a twist which follows the swirl of the flow of the air through the diffusor.

The transitions thus do not extend in vertical direction of the diffusor wall along a straight line but appropriately curved. The transition areas are designed such that they follow the flow direction of the air in the diffusor or the swirl of the flow downstream of the impeller of the ventilator. Accordingly, only minimal losses in the area of these transitions will result. The diffusor wall itself has, at least at the exit, an angular contour, wherein angular contour is to be understood also such that the transition between the sides of the diffusor wall can extend rounded. The angular design makes it possible to arrange several diffusors with only minimal spacing adjacent to each other so that in devices where only minimal space is available and several diffusors are required the latter can be arranged immediately adjacent to each other in a single row or behind each other in several rows. Since the diffusor has a round cross-section at the inlet, the diffusor according to the invention can be connected to conventional ventilators whose connecting area in general is designed to be round or circular. The diffusor according to the invention can therefore be installed also on already existing ventilators.

The outlet of the diffusor wall has advantageously a quadrangular contour so that neighboring diffusors with their respective contour sides either abut each other or with only minimal spacing can be positioned adjacent to and behind each other. Accordingly, the surface is utilized optimally for decelerating the flow velocity.

Depending on the configuration of the surface of the respective device, the diffusor walls, at least at the outlet, can have a triangular, quadrangular, hexagonal or other polygonal contour. Advantageous in this context is a quadrangular contour when the mounting surface has a corresponding quadrangular contour.

An optimal configuration results when the diffusor wall across the greatest part of its height has an angular contour. Diffusors positioned adjacent to each other and/or behind each other can then be arranged with minimal spacing or even so as to abut each other. In this way, an almost complete utilization of the corresponding device surface is possible.

The sides of the angular diffusor wall pass advantageously with continuous curvature into each other so that optimal flow conditions result.

In a preferred embodiment, the cross-section of the diffusor increases in the flow direction which is advantageous for reducing the flow velocity. It is advantageous when the cross-section of the diffusor, beginning at the entry end, first decreases and then increases. The flow can thereby be delayed with only minimal losses in the increasing cross-sectional area so that a high diffusor efficiency results.

Advantageously, the diffusor is provided with at least one additional wall which is surrounded at a spacing by the diffusor wall. Optimal flow conditions are provided with this additional wall.

The walls of the diffusor in this case can have the same height, but can also have different height, as desired. It is therefore very easily possible to achieve the desired flow conditions by an appropriate configuration of the diffusor walls.

The additional wall of the diffusor is advantageously configured similar to the outer diffusor wall. Accordingly, in an advantageous way the additional wall has an angular cross-section at least at the outlet.

The sides of the additional diffusor wall pass advantageously with continuous curvature into each other.

The diffusor is characterized in that the additional diffusor wall at the inlet has a round, preferably circular, contour which, across the height of the additional diffusor wall, has a continuous transition into the angular cross-section. Accordingly, the flow conditions are significantly improved even when using at least one additional diffusor wall.

The diffusor in accordance with the invention is characterized in that the transitions between the sides of the additional angular diffusor wall in the vertical direction has a swirl or a twist.

The diffusor provides optimal conditions. By selecting the angle between the two radial lines as well as the ratio between the diameter of the ventilator as well as the axial length of the diffusor, the flow conditions can be optimally adjusted to the respective situation of use. The relation between this angle and the dimensional ratio not only applies to the exterior diffusor wall but also to the possibly existing additional diffusor walls. In this connection, the value can be identical for all walls but can also be different from wall to wall.

An advantageous configuration results when the twist is in a range between approximately 50° and approximately 100°.

The diffusor is characterized in that the ratio of inlet cross-section to outlet cross-section of the diffusor is in a range of <approximately 5, advantageously between approximately 1.2 and approximately 3. By selecting the inlet and outlet cross-sections in a ratio relative to each other, the efficiency of the diffusor can be adjusted excellently to the situation of use.

The diffusor has the two walls whose outlet ends, for enlarging the outflow surface of the diffusor, are positioned at different height. By selecting the appropriate height of the walls, the size of the outflow surface can be matched to the situation of use.

Accordingly, the outlet ends of the walls in an advantageous embodiment can be located on a curved surface that can be, for example, a spherical or cylindrical surface. In this way, in a small available space a large outflow surface can be provided wherein the ratio between the size of the outflow surface and the size of the inflow surface can be selected to be large. The larger this surface ratio, the greater the conversion of the dynamic energy of the air flow at the diffusor inlet into pressure energy. The large outflow surface leads to a reduction of the air that is exiting through the passage and thus to an increase of the efficiency.

In another embodiment, the outlet ends of the walls can also be located in the surface of an imaginary square or a pyramid. In this way, a very large exit surface for a given available space is provided also.

The inlet ends of the walls can be positioned in a common plane.

It is however also possible in another advantageous embodiment that the inlet ends of the walls are positioned in different planes, i.e., have different spacing relative to the inlet cross-section of the diffusor. Such a configuration of the diffusor leads to a particularly low-loss embodiment.

When in at least one wall of the diffusor at least one opening is provided through which neighboring passages of the diffusor are in fluid communication, a flow separation in the corresponding passage can be prevented or at least delayed.

The opening in this case can be a gap that extends at least around a portion of the circumference of the corresponding diffusor wall. It is however also possible to employ cutouts, stamped-out parts or transverse slots as passages wherein these different configurations of the openings can be used also in combination with each other on the inner wall of the diffusor. When the diffusor comprises, in addition to the exterior wall, more than one additional walls, then these openings can be provided in at least one of these additional walls, but also in two or more of the additional walls. Such openings can be provided also in the exterior wall of the diffusor.

The ventilator in accordance with the invention is characterized in that the transitions at the exit end between the sides of the wall have a curvature which is in a range of approximately $<0.5\times D$. In this way, the transitions at the exit end can be designed such that optimal flow conditions result.

The curvature is advantageously in a range of approximately $<0.25\times D$.

In an embodiment of the ventilator, the exit surface of the wall with the rounded transition is smaller than the exit surface without rounded transition at the exit end. In this context, the surface deviation is in a range between approximately 1 and approximately 1.27, preferably between approximately 1 and approximately 1.05.

In the ventilator, the ratio of axial length of the diffusor to the diameter of the ventilator is in a range of approximately $<5$, preferably between approximately 0.2 and approximately 2. In this way, the efficiency of the diffusor can be precisely adjusted to the given mounting conditions.

In the ventilator, the diffusor is designed such that the transitions between the sides of the diffusor wall in the vertical direction have a twist that follows the swirl of the flow of the air through the diffusor.

The ventilator is characterized in that the diffusor comprises the additional wall which at the inlet has a round, preferably circular, cross-section that passes continuously into an angular cross-section across the height of the additional wall.

The ventilator comprises the diffusor that is designed such that the transitions between the sides of the additional wall in the vertical direction have a swirl or a twist.

The ventilator is characterized in that the diffusor comprises a wall that passes, across the height of the wall, from a round inlet cross-section into an angular outlet cross-section wherein the transitions between the sides of the wall in the vertical direction have a twist which is configured by taking into consideration the angle between the two radial lines as well as the diameter of the ventilator and the axial length of the diffusor.

In the ventilator, the diffusor is designed such that the ratio of inlet cross-section to outlet cross-section is in a range $<$ approximately 5, preferably between approximately 1.2 and approximately 3.

The ventilator comprises the diffusor whose at least two walls are designed such that their outlet end, for enlarging the outflow surface, is positioned at different height.

The device in accordance with the invention is designed such that the topside of the housing sidewall can be used optimally for the arrangement of the diffusors. On the topside of the housing at least two ventilators with diffusors are arranged. In this context, these ventilators with diffusors can be arranged at any suitable side of the device housing.

Advantageously, the diffusors have an angular outlet cross-section. The angular design makes it possible to position the several diffusors with only minimal spacing adjacent to each other so that in devices in which only a limited space is available and several diffusors are to be used the latter can be arranged, immediately adjacent to each other, in one row or in several rows behind each other. When the outlet cross-sections have a quadrangular outlet cross-section, neighboring diffusors with their respective contour sides can be either abutting each other or can be positioned with only minimal spacing adjacent and behind each other. Accordingly, the housing side is utilized optimally for decelerating the flow velocity.

The contour shape of the diffusors at the outlet end is designed preferably in accordance with the contour shape of the housing side where the diffusors are provided. Accordingly, the surface of the housing side can be furnished optimally with corresponding diffusors wherein the housing side can be utilized correspondingly in an optimal fashion.

The invention not only results from the subject matter of the individual claims but also from the entire disclosure and features disclosed in the drawings and the description. They are considered important to the invention, even though they may not be subject matter of the claims, inasmuch as they are novel, individually or in combination, relative to the prior art.

Further features of the invention result from the additional claims, the description, and the drawings.

BRIEF DESCRIPTION OF THE DRAWINGS

The invention will be explained in the following with the aid of several embodiments illustrated in the drawings in more detail. It is shown in.

Figure 12:
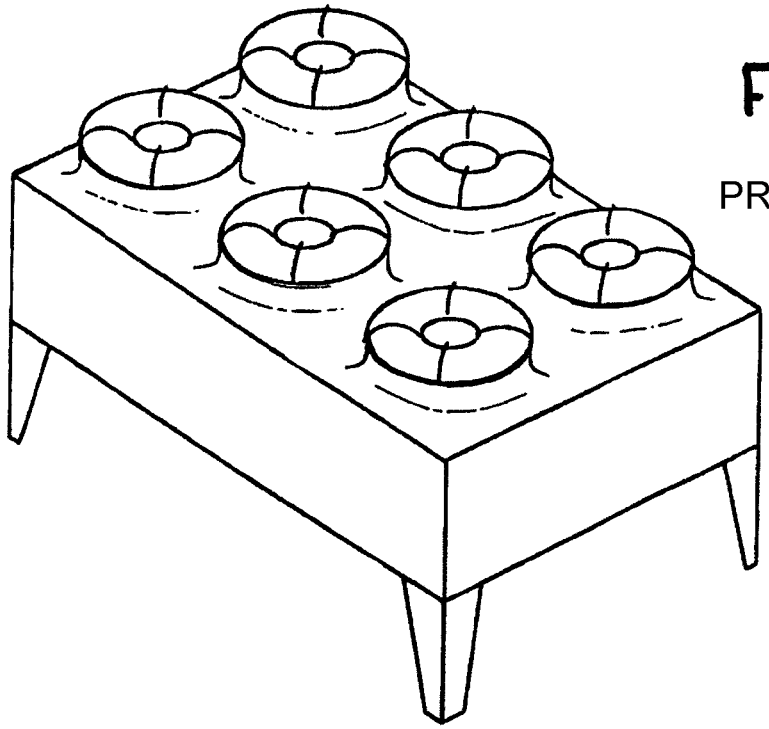
Fig. 12 PRIOR ART
Figure 10:
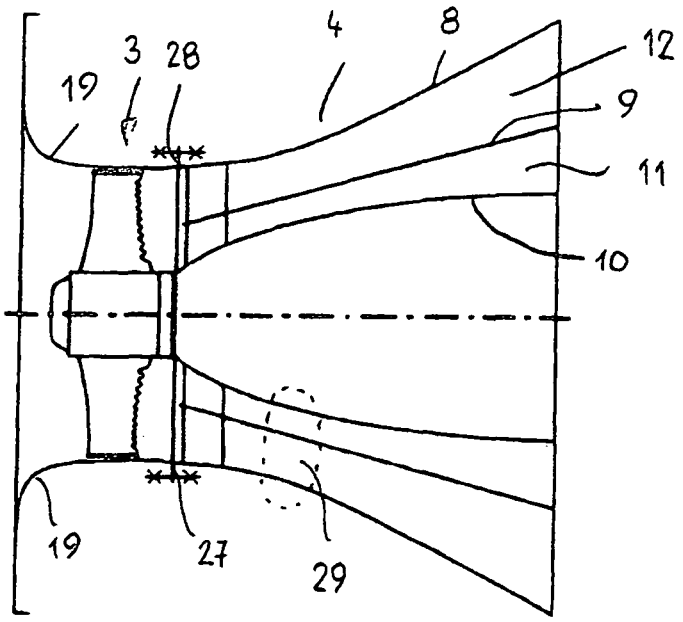
Figure 11:
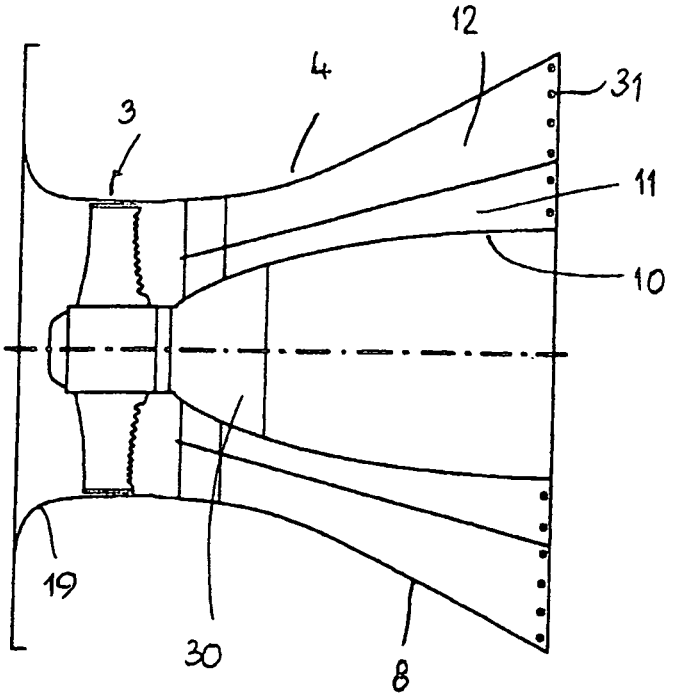
Figure 13:
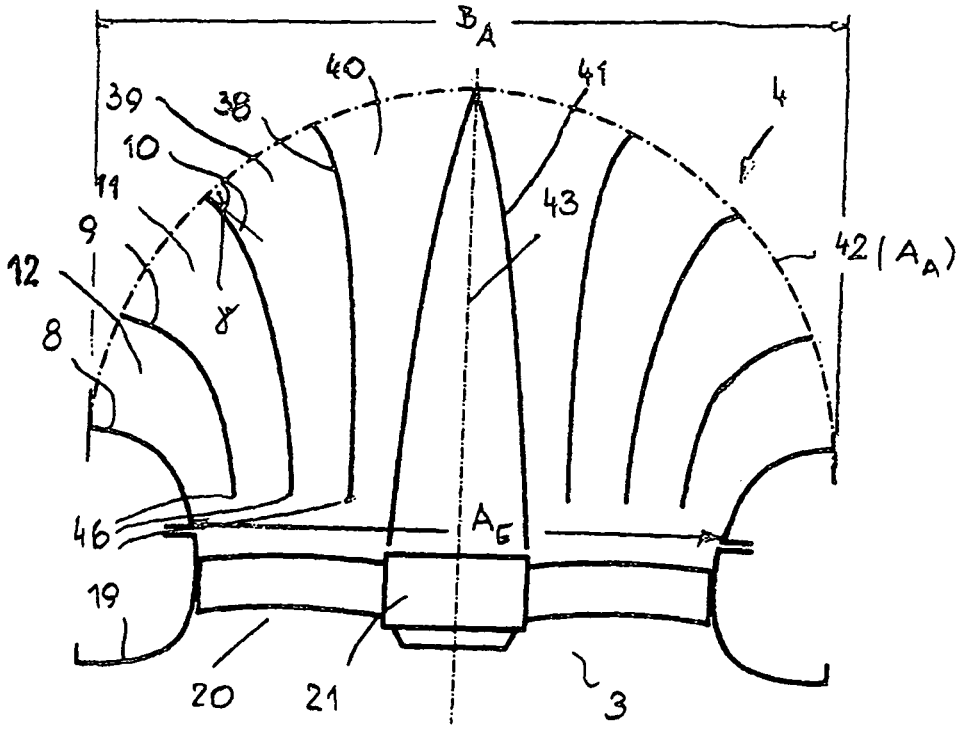
Figure 14:
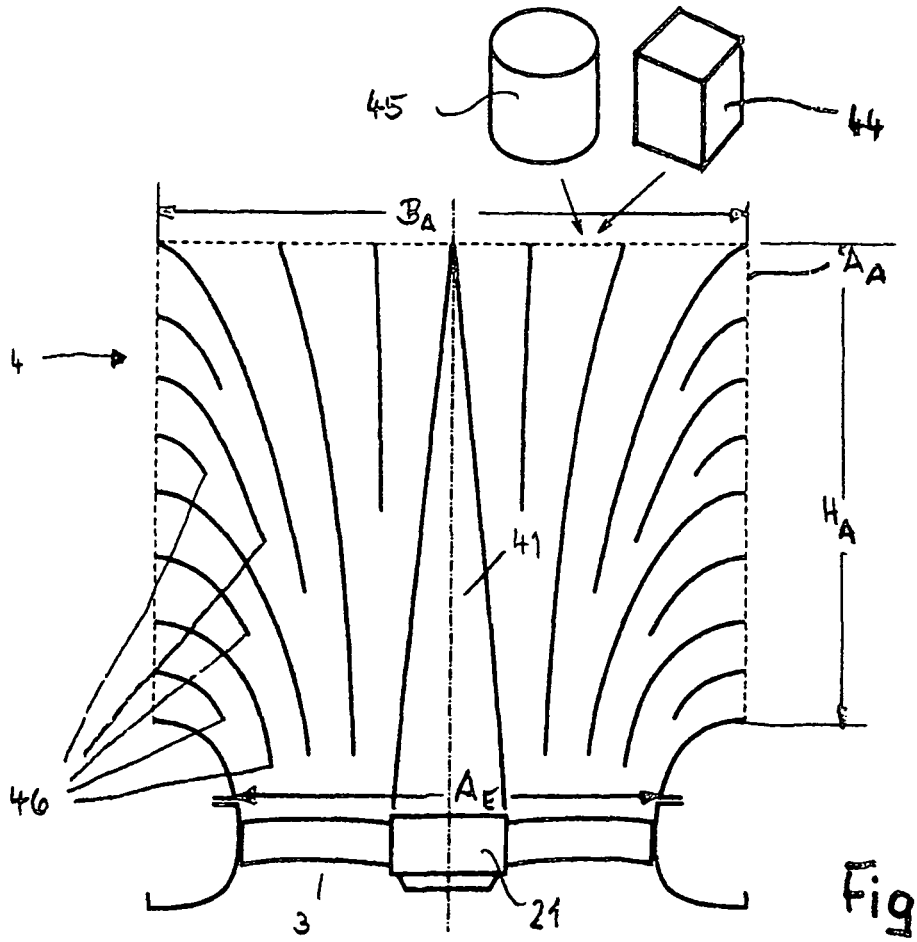
Figure 15:
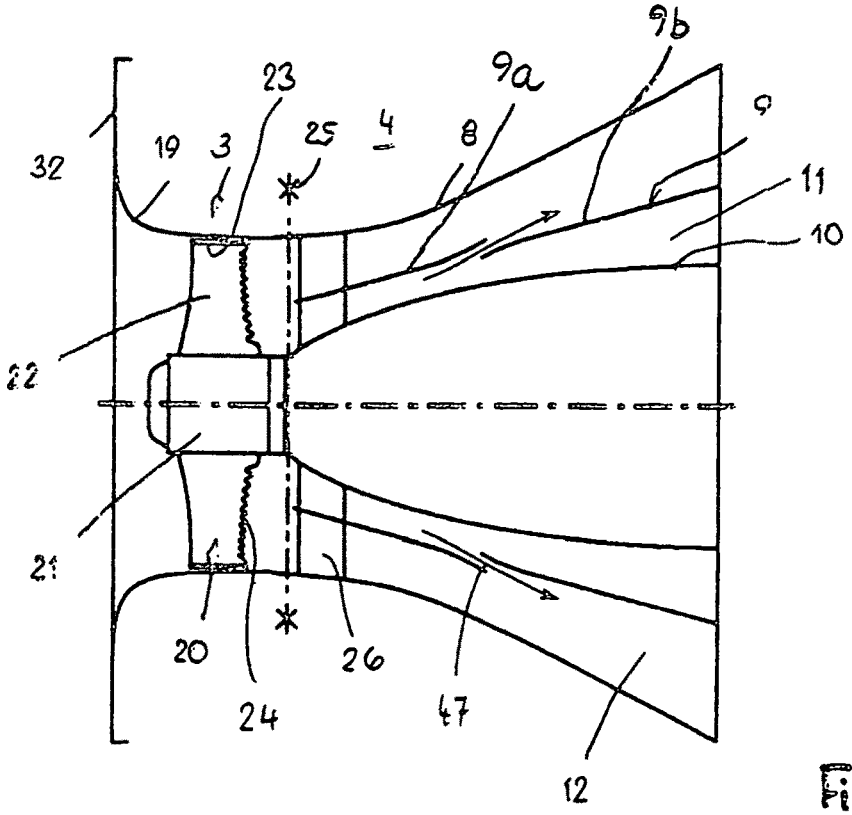
Figure 16:
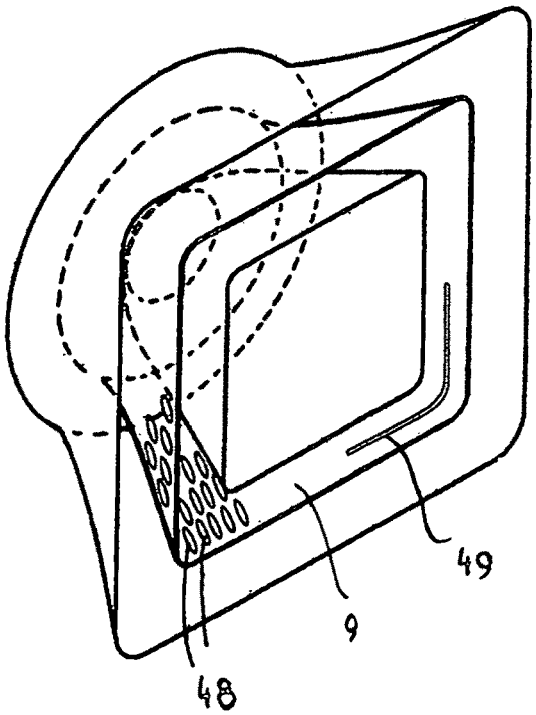

FIG. 10 in axial section, respectively, two possible attachments of exit diffusors on ventilators in accordance with the invention;

FIG. 11 in a simplified illustration a further embodiment of an exit diffusor according to the invention;

FIG. 12 a device with ventilators according to the prior art;

FIG. 13 in axial section a further embodiment of an exit diffusor according to the invention;

FIG. 14 in axial section a further embodiment of an exit diffusor according to the invention;

FIG. 15 in axial section a further embodiment of an exit diffusor according to the invention;

FIG. 16 in perspective illustration a further embodiment of an exit diffusor according to the invention.

DESCRIPTION OF PREFERRED EMODIMENTS

Figure 1:
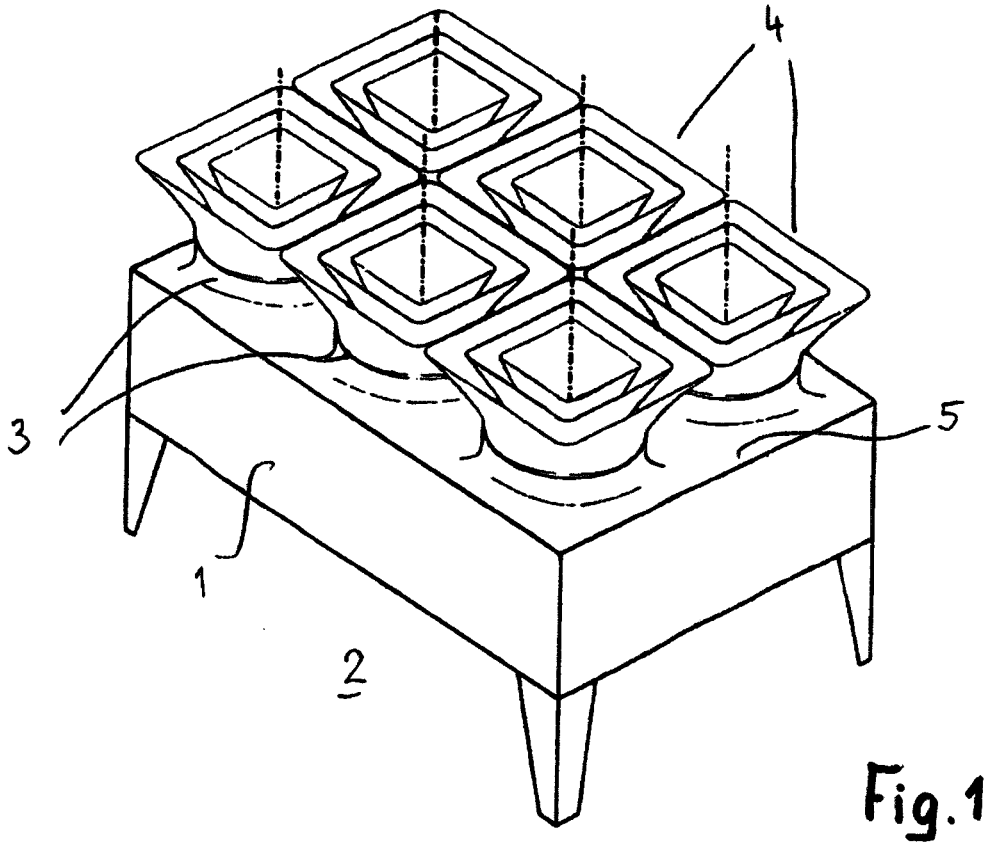
FIG. 1 in perspective illustration exit diffusors of ventilator units in accordance with the invention, arranged on a housing.

FIG. 1 shows in schematic illustration a housing 1 of a device 2 that is, for example, a heat exchanger. The device 2 in the illustrated embodiment is a freestanding device but can also be a device mounted on a wall, a ceiling, and the like. The device 2 has several ventilators 3 that, for example, are arranged in two rows with minimal spacing behind each other. The ventilators 3 can be provided with pressure action or vacuum action at the device or can also be integrated into the device 2.

The ventilators 3 comprise each an exit diffusor 4 (in the following referred to as diffusor) by means of which the exit losses are minimized in that the velocity of the exiting air is converted to pressure.

The diffusors 4 are provided on the rectangular topside 5 of the housing 1. In order to utilize optimally this rectangular topside 5, the diffusors 4 have a quadrangular contour. This results in an especially high efficiency improvement. The quadrangular shape leads to a great exit surface for the exiting air. Also, in this way no flow separation occurs.

The diffusors 4 are, for example, arranged such that they contact each other with their neighboring rims, as is illustrated in particular in FIG. 1.

Based on FIG. 2, a diffusor 4 will be explained in more detail. It has an annular interface 6 with which the diffusor 4 can be connected to the ventilator. The outer rim 7 of the interface 6 is adjoined by a wall 8 which initially has a circular cross-section and passes, with increasing spacing from the outer rim 7, continuously into a quadrangular contour shape. The wall 8 has across a portion of its height a quadrangular contour.

As shown in the drawings, the corners of the walls 8 to 10 are rounded. Despite of this, in the following the term quadrangular contour shape is used. However, an embodiment is possible in which the corners at the exit end of the diffusor are indeed sharp-edged.

In principle, the single wall 8 as a diffusor wall is sufficient for the diffusor 4. In the embodiment according to FIG. 2, two intermediate walls 9 and 10 are provided which across their height have a spacing to each other so that between the two intermediate walls 9 and 10 a passage 11 is formed. Between the intermediate wall 9 and the exterior wall 8 there exists also a spacing across the entire wall height so that between the two walls 8 and 9 an additional passage 12 for the air is formed. The passages 11, 12 have a quadrangular shape. The intermediate walls 9, 10, like the jacket 8, have also a transition from a circular interface 13, 14 into the quadrangular shape wherein the quadrangular shape is to be understood in the same way as in case of the wall 8. The interfaces 13, 14 have smaller diameter than the interface 6 wherein the interface 14 of the inner intermediate wall 10 has a smaller diameter than the interface 13 of the central intermediate wall 9. The interface 14 has advantageously approximately the same diameter as the hub 21 (FIG. 9) of the impeller 20.

The walls 8 to 10 are designed such that the contour of the walls in the direction toward their free end increases, preferably increases continuously. The walls 8 to 10 have therefore at the free end the greatest contour.

The course of the walls 8 to 10 can be designed such that, beginning at the interfaces 6, 13, 14, they extend at least approximately parallel to each other. The walls 8 to 10, depending on the flow conditions, can however also be designed such that they do not extend parallel to each other.

Figure 2:
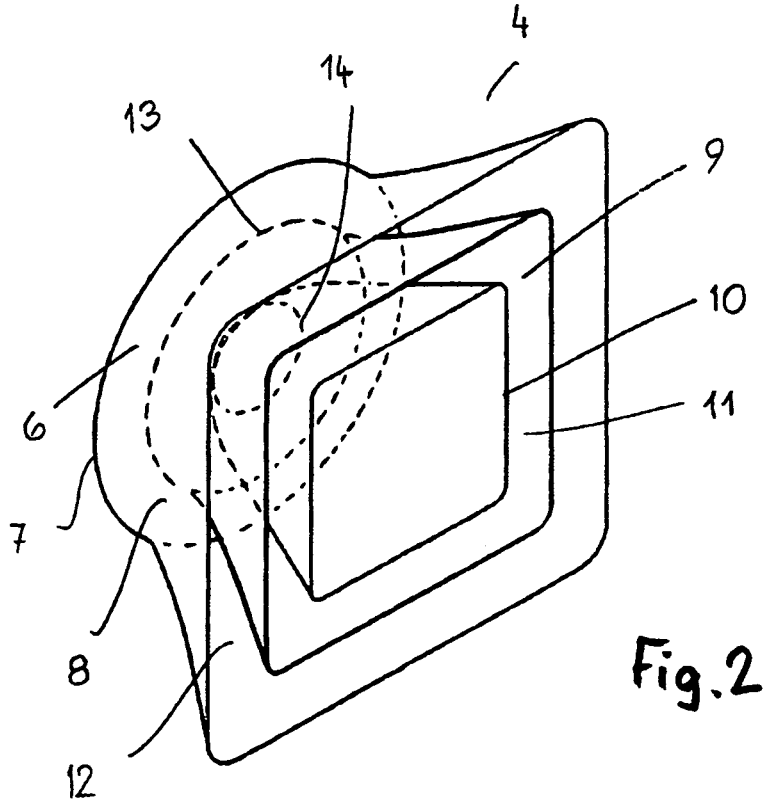
FIG. 2 in perspective and enlarged illustration the exit diffusor according to the invention.
Figure 3:
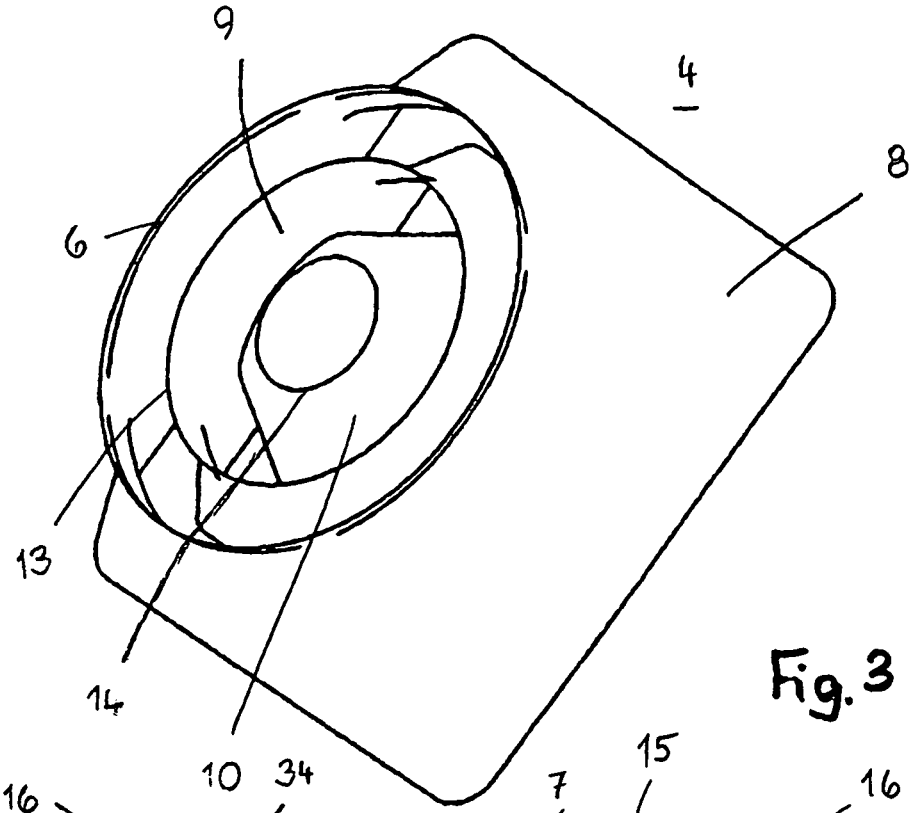
FIG. 3 a rear view of the exit diffusor according to FIG. 2.

In the embodiment according to FIG. 2, two intermediate walls 9, 10 are provided. The diffusor 4 can also be provided with only one intermediate wall or more than two intermediate walls.

The walls 8 to 10 have in the embodiment according to FIG. 2 same height so that their free ends are positioned in a common plane. The walls 8 to 10 can also be of different height. For example, the height of the walls 8 to 10 decreases from the exterior to the interior. However, two of the walls 8 to 10 can also be of the same height and the third wall can be higher or shorter than the two other walls. The height of the walls can thus be matched optimally to the respective flow conditions so that the exit losses are minimized.

The intermediate walls 9, 10 are fixedly connected to each other and the exterior wall 8 in a suitable way, for example, by transverse webs with which the walls are connected to each other.

Figure 4:
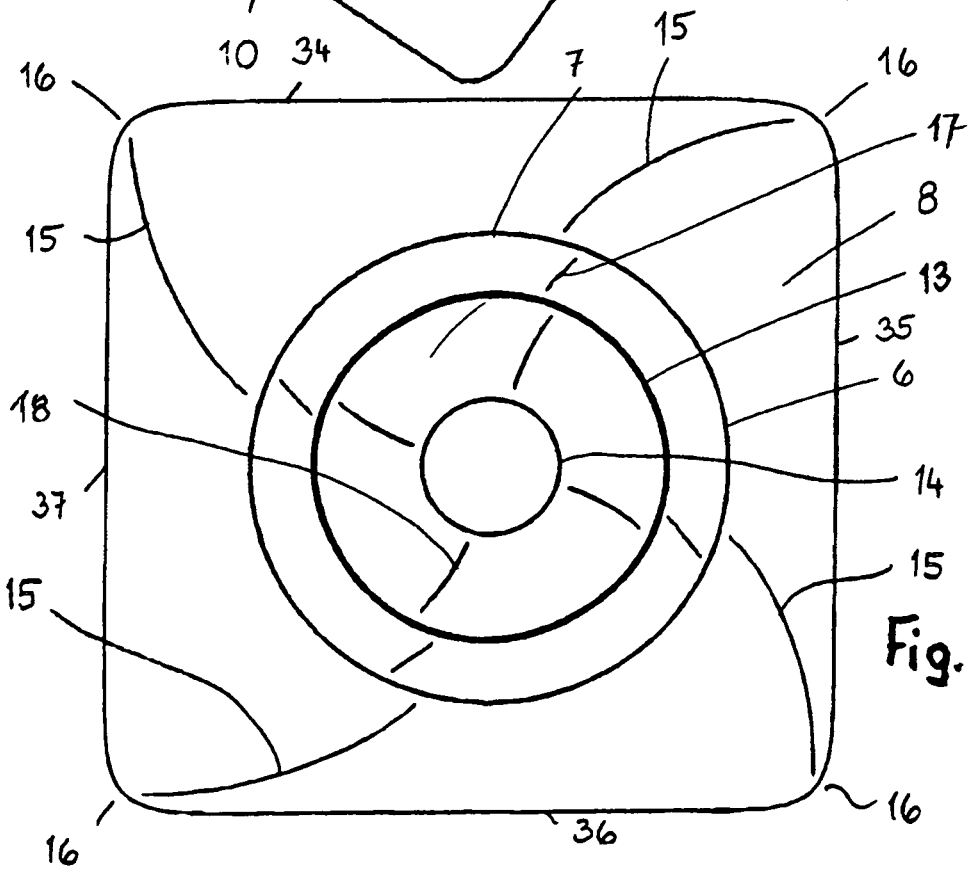
FIG. 4 a rear view of a further embodiment of an exit diffusor according to the invention.
Figure 5:
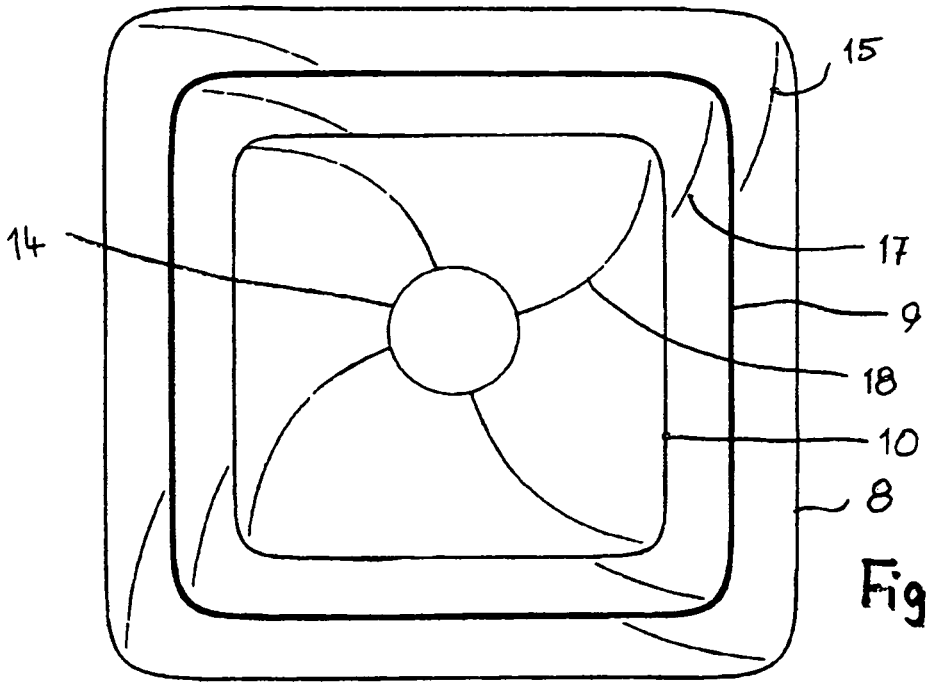
FIG. 5 a plan view of the exit diffusor according to FIG. 4.
Figure 6:
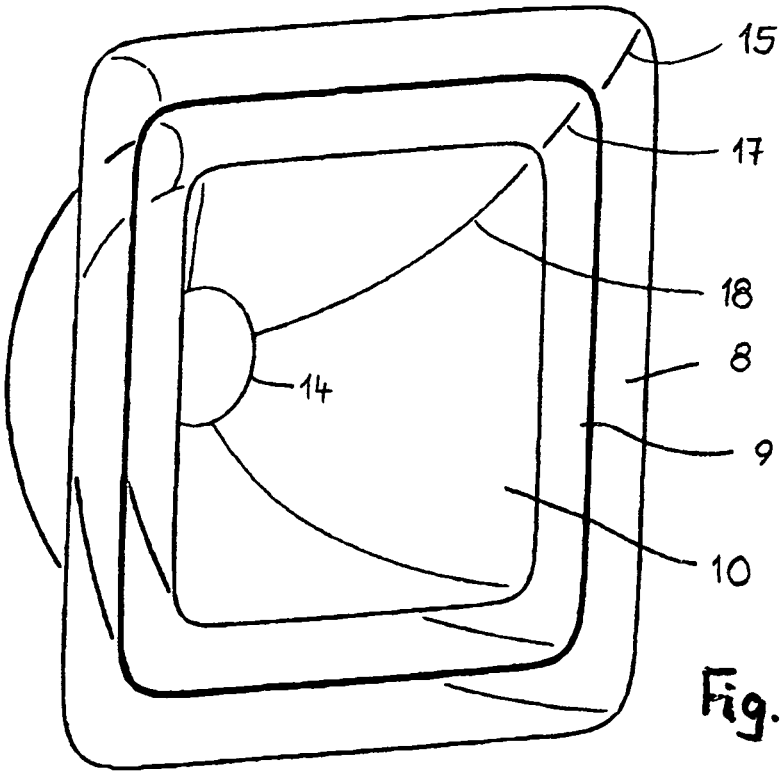
FIG. 6 an exit diffusor according to FIG. 5 in perspective illustration.
Figure 7:
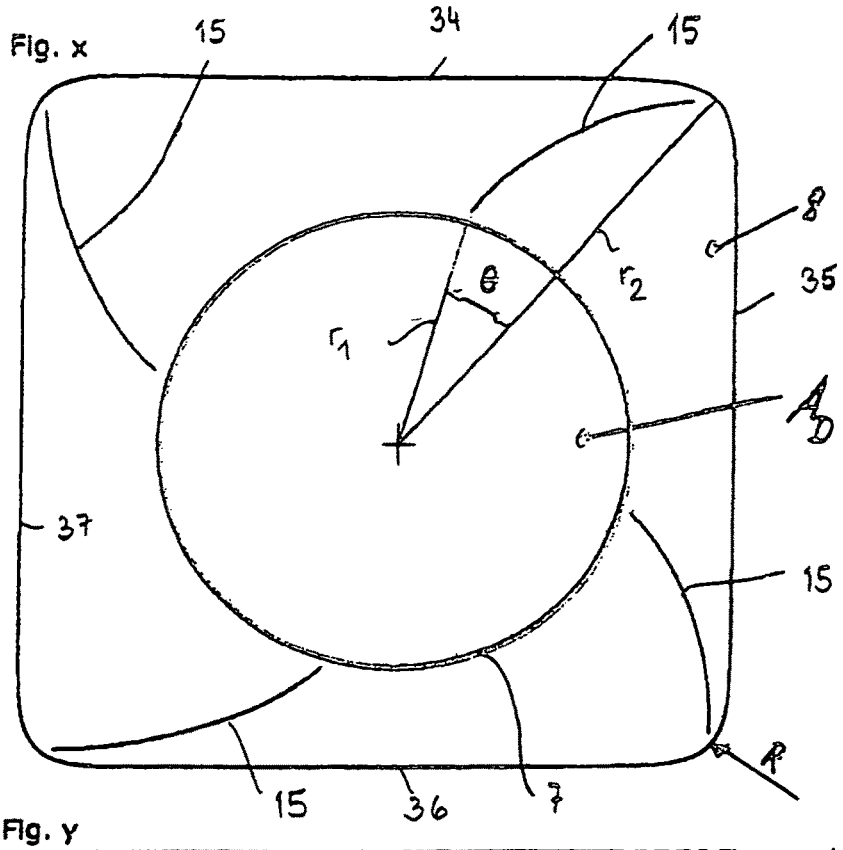
FIG. 7 a rear view of an exit diffusor with a swirl in the walls.

The four sides 34 to 37 (FIG. 7) of the walls 8 to 10 pass continuously into each other. The transition, as can be seen, for example, in FIG. 2, can be realized such that the transition areas 15, 16 between the sides 34 to 37 of the wall 8 extend across their height in a curved form. This extension across the height of the wall 8 is indicated by the lines 15 in FIG. 4. The transition area 15, 16 extends almost across the entire height of the wall 8. The curvature is provided such that the transitions 15, 16 have a swirl and follow the flow direction of the air behind the impeller (not illustrated) of the ventilator 3. As can be seen in FIG. 7, the curvature is such that the transition areas 15, 16 across their length are positioned at an angle relative to a radial line of the diffusor which extends through the rounded corner 16 of the wall 8.

As a result of the described course, there are at most very minimal flow losses due to the transitions 15, 16. As a result of the curvature, the transitions 15, 16 follow the swirl of the air flow within the diffusor 4. The transitions 15, 16 extend approximately from the exit end of the wall 8 into close proximity to the circular outer rim 7 of the interface 6.

In the same way, the intermediate walls 9 and 10 are also provided with such transitions 17, 18 that are also curved in accordance with the flow course of the air behind the impeller in a swirl shape and extend from the transition areas between the sides of the intermediate walls 9, 10 into close proximity to the respective interface 13, 14.

In the embodiment according to FIGS. 4 through 7, all walls 8 to 10 are provided with the curved transitions. However, it is also possible to have these curved transitions only at one or only at two of the walls 8 to 10 of the diffusor 4. Accordingly, in combination with the contour design of the walls 8 to 10 an optimal adaptation to the respective desired flow conditions can be achieved.

The transitions 15, 16; 17, 18 extending approximately across the height of the walls 8 to 10 can also extend straight, viewed in the axial direction of the diffusor 4, wherein again these transition areas are positioned at an angle relative to the radial line of the diffusor.

In the described embodiments, the walls 8 to 10 have a square contour. However, they can also have a rectangular, hexagonal or, for example, also a triangular contour. The contour shape depends in particular on the shape of the corresponding side of the housing 1 on which the diffusors 4 are provided. The contour shape of the flow outlet can thus be selected such that the available housing side can be utilized optimally.

The described twist (swirl) between the sides of the walls 8 to 10 is an advantageous configuration for the diffusors 4 but it is not mandatorily required. In particular in combination with the dimensions or dimension ratios still to be described, the diffusors 4 are distinguished by excellent properties for use, even without such twist (swirl) at the transitions between the sides of the walls.

Figure 9:
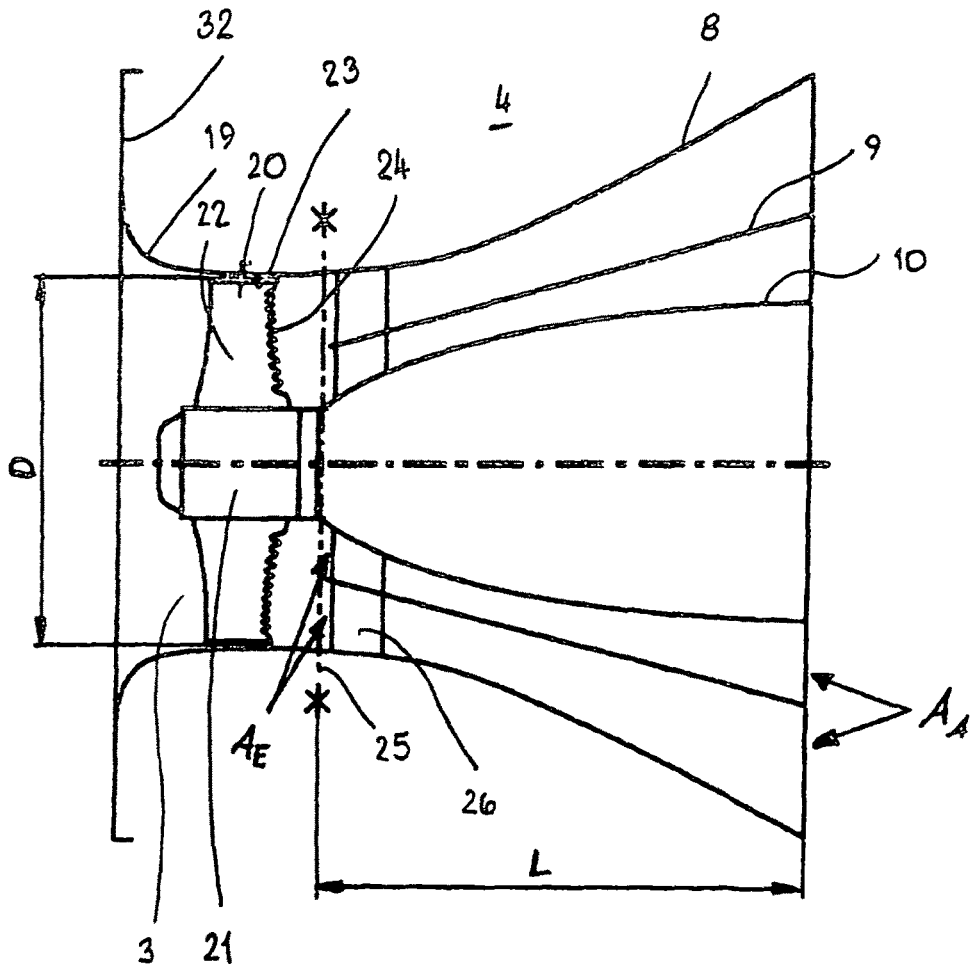
FIG. 9.

FIG. 9 shows the attachment of the diffusor 4 to a nozzle 19 of the ventilator 3. The nozzle 19 has a circular contour. The ventilator 3 comprises the impeller 20 with hub 21 from which the vanes 22 are projecting at uniform spacings. They are advantageously provided at the radial outer rim with a winglet 23, respectively. The rearward edge 24 of the vane 22, in the rotational direction, is provided with tooth-like profiles.

Of course, the vanes 22 of the impeller 20 can also have any other suitable configuration.

The diffusor 4 is radially connected with the nozzle 19 of the ventilator 3, preferably by a screw connection, which is indicated by the dash-dotted line 25.

The nozzle 19 is provided at a nozzle plate 32 which has approximately the same cross-section as the free end of the wall 8. The nozzle 19 and the nozzle plate 32 are advantageous embodied monolithic with each other, but can also be components that are separate from each other and, in a suitable way, are connected fixedly with each other. The nozzle plate 32 has advantageously the same angular contour as the outlet end of the wall 8. Accordingly, the ventilators 3 can be arranged tightly behind and/or adjacent to each other. The nozzle plates 32 and the walls 8 of the diffusors 4 of neighboring ventilators 3 can abut each other in this context, as illustrated in FIG. 1.

The diffusor 4 comprises the outer wall 8 and the intermediate walls 9, 10. In axial section, as illustrated in FIG. 9, the sides of the outer wall 8 are approximately concave. The sides of the intermediate wall 9 extend in axial section approximately straight while the sides of the intermediate wall 10 have an approximately convex extension. Such a configuration of the walls 8 to 10 can be provided in all of the described embodiments.

In the flow direction behind the impeller 20, guide vanes 26 can be provided in the diffusor 4 that extend between the walls 8 to 10 and are rigidly arranged. The guide vanes 26 are positioned on the side of the radial attachment 25 or, in the embodiment according to FIG. 10, of the axial attachment, which side is facing away from the vanes 22. The diffusor 4 is positioned with its interface 6 onto or into the nozzle 19 and is fixedly connected by the radial attachment 25, which is advantageously a screw connection, to the nozzle.

The walls 8 to 10 of the diffusor 4 can be designed in the described embodiments so as to have a noise-damping action so that in use of the ventilators only a quiet operating noise is produced. The walls 8 to 10 can also be formed in the described embodiments so as to be adjustable so that in regard to their contour shape they can be matched at least across a portion of their height to the flow conditions and/or mounting conditions. The walls 8 to 10 can be advantageously designed, for example, for adjustability, to be flexible across at least a portion of their height.

FIG. 10 shows the possibility to attach the diffusor 4 also axially on the nozzle 19 of the ventilator 3. For this purpose, the interface 6 of the outer wall 8 can be provided with a radially outwardly extending annular flange 27 that is axially attached to a radially outwardly extending annular flange 28 on the free end of the nozzle 19. Advantageously, this axial attachment is also a screw connection that makes it possible to remove the diffusor 4 from the nozzle 19, as needed.

The diffusor 4, as a result of the intermediate walls, can be relatively short. The air that is conveyed by the impeller 20 passes between walls 8 and 9 or 9 and 10. The flow cross-section of the passages 11 and 12 initially decreases in the flow direction until, in the area 29 indicated with the dashed line, it has its smallest cross-section. The air is accelerated within this area 29 which leads to a more uniform flow of the air flow. The air flow can thereafter be decelerated with reduced losses so that a high degree of efficiency of the diffusor 4 results. From the area 29, the flow cross-section of the passages 11, 12 increases in the direction of the exit end, preferably continuously. The cross-section constriction 29 prevents moreover a premature flow separation (collapse of the flow) in the passage 11 and 12.

FIG. 11 shows an exemplary and advantageous use of the diffusor 4. The inner intermediate wall 10 surrounds a connecting box 30 or a space for electronic devices when an external rotor motor is used for the ventilator 3. In case of an internal rotor motor, the part 30 would be the motor of the ventilator. The air flow generated by the ventilator 3 flows through the passages 11, 12. By means of the air flow that is passing through the passage 11 the surface of the motor 30 is cooled well so that an effective cooling of the electronic devices or electrical components of the motor is achieved.

In the embodiment according to FIG. 11, the outer wall 8 of the diffusor 4 is formed monolithic with the nozzle 19. The exit area of the two passages 11, 12 is covered by a touch guard 31 which is formed by an appropriate grid or by individual grid rods. The touch guard 31 has a large spacing from the rotating impeller 20. The touch guard 31 can thus be designed such that only minimal pressure losses occur upon exit of the air from the diffusor 4 and only a minimal noise development occurs. This effect can in particular be achieved in that the touch guard 31 has an appropriately large mesh width.

The described touch guard 31 can be employed in all described and illustrated embodiments.

The diffusor 4 of the described embodiments can be used for evaporators, liquefiers, air coolers, aftercoolers, and the like. As disclosed in connection with FIGS. 9 to 11, the diffusor 4 can be provided with a support function for receiving the ventilator motor 30.

The ventilators 3 can be axial but also diagonal ventilators. The diffusor 4, when not provided with swirl transition areas 15, 16; 17, 18 in the walls 8 to 10, can also be used for radial ventilators.

The radius R at the exit end of the wall 8 (FIG. 7) is advantageously in a range of <0.5×D wherein D is the diameter of the impeller 20 (FIG. 9). In an advantageous embodiment, the radius R of the rounded corners of the wall 8 is in a range of<approximately 0.25×D. This configuration is valid for diffusors 4 with and without twist (swirl).

Figure 8:
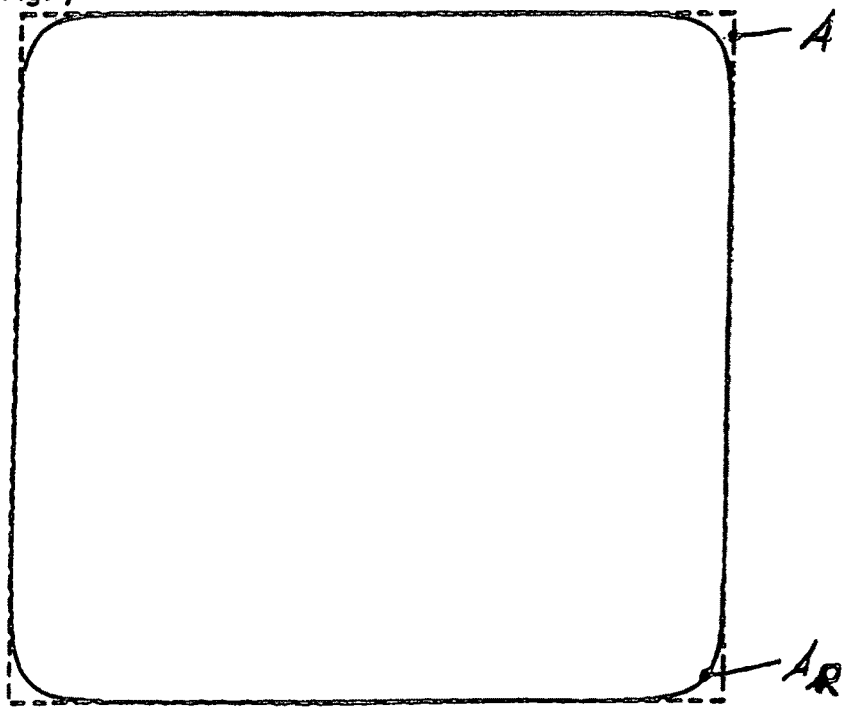
FIG. 8 the rounded portions at the transitions between the sides of the walls of the exit diffusor and the surface ratio between a quadrangular and a quadrangular outlet cross-section with rounded ends.

As can be seen in FIG. 8, the exit surface of the wall 8 as a result of the rounded corners is smaller than a quadrangular contour shape at the exit end. The surface deviation $A/A_R$ of the maximally available angular surface A is in a range between approximately 1 and 1.27, preferably in a range between approximately 1 and approximately 1.05. By appropriately selecting the radius R of the rounded corner, an optimal exit cross-section of the wall 8 of the diffusor 4 can thus be provided so that the diffusor can be adjusted to the given mounting conditions. The described ratio can in principle also be used for the walls 9 and 10. The rounded portion must not be a portion of a circular arc (radius R) but can also have different shapes. The described surface ratio applies to diffusors with and without twist (swirl).

Also, the efficiency of the diffusor can be optimally adjusted by the ratio of length L to diameter D of the ventilator 3 relative to the given mounting conditions. This length/diameter ratio L/D is in a range of <5, preferably in a range of approximately 0.2 to approximately 2. This ratio applies to all described embodiments, in particular also to diffusors without twist (swirl).

Also, the selection of the inlet and outlet cross-section relative to each other can have an effect on the efficiency of the diffusor 4. In FIG. 9, the inlet cross-section is identified at $A_E$ and the outlet cross-section of the diffusor 4 at $A_A$. The ratio of outlet surface to inlet surface $A_A/A_E$ is in a range of less than approximately 5, advantageously in a range between approximately 1.2 and approximately 3. The surface ratio applies to all embodiments, in particular also to diffusors without twist (swirl).

The twist or swirl 15, 16; 17, 18 described in connection with FIGS. 4 to 7 is defined by the formula θ×D/L wherein the angle θ is measured between the two radial lines $r_1$ and $r_2$. The radial line $r_1$ extends through the intersection area between the transition area 15 and the inner free rim 7 of the wall 8. The radial line $r_2$ extends on the other hand to the corner area of the wall 8 located within the exit surface from where the transition area 15 extends. This twist or this swirl θ×D/L is in a range between 0° and 360°, advantageously however in a range between approximately 50° and 100°.

This formula applies to all walls 8 to 10. The value can be identical for all walls but can also be different from wall to wall.

The following embodiments according to FIGS. 13 to 16 are designed such that with a larger exit surface of the diffusors the exit velocity is further reduced and thus the efficiency can be significantly increased.

FIG. 13 shows a diffusor 4 which, similar to the embodiment according to FIG. 10, is attached axially on the nozzle 19 of the ventilator. The diffusor 4 has, aside from the outer wall 8, the intermediate walls 9, 10, and 38. They are each configured to extend circumferentially and delimit passages 11, 12, 39, 40 through which the air that is sucked in by the ventilator is flowing. The walls 8 to 10, 38 are of a curved configuration, respectively, across their height and arranged such that the flow cross-section of the passages 11, 12, 39, 40 increases in the flow direction. The inner intermediate wall 38 surrounds at a spacing a central guide member 41 which continues the outer contour of the hub 21 of the impeller 20 of the ventilator 3 and which continuously tapers away from the hub 21 in the flow direction of the air until it tapers out to a point. The guide member 41 is approximately conical with a curved cone envelope line.

Instead of the guide member, the diffusor 4 can also comprise a circumferential wall 41 in accordance with the preceding embodiments.

The walls 8 to 10, 38, 41 of the diffusor 4 are designed such that their outlet ends are positioned at different heights. In the illustrated embodiment, the outlet ends of the walls, viewed in axial section, are positioned on a circular arc 42. The center point of the circular arc 42 is positioned on the axis 43 of the guide member 41 in the area between the hub 21 and the guide member tip. The guide member tip itself is also positioned on the circular arc 42.

The inflow end 46 of the walls 8 to 10, 38, 41 is positioned at the same height while the outlet ends of the walls are positioned at different heights on the circular arc 42. The height of the walls increases from the wall 8 to the intermediate wall 38 as well as the jacket of the guide member 41. As a result of the different height of the walls 8 to 10, 38, 41, a large diffusor exit surface $A_A$ results which is indicated in axial section by the circular arc 42. The diffusor inlet surface $A_E$ is substantially smaller than the diffusor outlet surface $A_A$. The greater the ratio of diffusor outlet surface $A_A$ to diffusor inlet surface $A_E$, the more of the dynamic energy of the air flow at the diffusor inlet is converted into pressure energy.

The contour shapes of the diffusor walls 8 to 10, 38, 41 can be angular or round. In an exemplary embodiment with exclusively rounded cross-sections of the diffusor walls 8 to 10, 38, 41, a diffusor exit surface $A_A$ results which is approximately located on a spherical surface, for example, on a semi-sphere surface. The spherical surface is significantly greater than incase of diffusor walls whose exit ends are in a planar surface whose width is $B_A$. The inflow edges 46 of the walls 9, 10, 38, 41 are positioned in this embodiment in a common radial plane of the diffusor 4 but can also be positioned at different height.

A particularly advantageous embodiment results when the diffusor walls 8 to 10, 38, 41 are positioned at the exit end at an angle γ of approximately 90° to the corresponding tangent at the circular arc 42 and thus to the imaginary diffusor exit surface $A_A$.

In principle, the end areas of the diffusor walls 8 to 10, 38, 41 can also be positioned at other angles to the circular arc 42.

The diffusor exit surface can also be designed such that in axial section it has the shape of half of an ellipse. The length of one semiaxis which extends transverse to the ventilator axis is delimited by the available mounting space. The length of the other semiaxis which is parallel to the ventilator axis can be selected to be larger so that the diffusor exit surface $A_A$ can be enlarged accordingly.

For a given mounting space, the size of the exit surface $A_A$ can be maximized by combination of diffusor walls with angular and round contour by means of different axial height of the diffusor walls.

FIG. 14 shows in axial section a further possibility for enlarging the diffusor exit surface $A_A$ in comparison to the diffusor inlet surface $A_E$. In contrast to the preceding embodiment, the exit surface $A_A$ has a U-shape in axial section. When the diffusor walls have, for example, a rectangular contour, the exit surface $A_A$ is then provided at the outer sides of an imaginary parallelepiped 44 that are positioned at right angles to each other. When the diffusor walls, on the other hand, have a round, for example, circular contour, then the exit surface $A_A$ is positioned approximately on the cylinder envelope of an imaginary cylinder 45.

In FIG. 14, the exit surface $A_A$ in axial section is characterized by the dashed line. This shows that the air that is sucked in by the ventilator exits at different sides of the diffusor. The ratio between the diffusor exit surface $A_A$ to the diffusor inlet surface $A_E$ is very large so that very much of the dynamic energy of the air flow is converted into pressure energy and the efficiency is significantly increased.

In the rectangular contour of the exit surface $A_A$ illustrated in FIG. 14, viewed in axial section, the height $H_A$ of the exit surface independent of the mounting space of the diffusor can be selected transverse to the ventilator axis. Depending on the magnitude of the height $H_A$, the exit surface $A_A$ can be more or less enlarged.

In the embodiment, the diffusor has a plurality of walls that are each positioned at a spacing to each other and form air passages between them.

The walls of the diffusor 4 are curved across their height. The walls are designed in this context such that the flow cross-section of the passages between the walls in the flow direction widens. The walls can have round and/or angular contour. Some of the walls of the diffusor 4 open into the lateral surfaces and some into the end face of the diffusor. The walls of the diffusor 4 are designed such, respectively, that the exit ends are located at the level of the end face or of the lateral surface(s) of the imaginary parallelepiped 44 or of the imaginary cylinder 45.

As can be seen also in FIG. 14, the inlet ends 46 are positioned at different axial height. Accordingly, the inlet ends 46 of the diffusor walls have different spacing from the diffusor inlet.

Such a configuration of the diffusor leads to a particularly low-loss embodiment.

The guide member 41 is also centrally arranged and extends from the hub 21 upward. The guide member 41 is conical wherein the cone tip is positioned in the end face of the imaginary parallelepiped 44 or of the imaginary cylinder 45. Instead of the guide member, the diffusor 4 can have a circumferential wall 41 according to the embodiments of FIGS. 1 to 11.

The different walls of the diffusor 4, as has been described in the preceding embodiments, can be connected with each other by narrow webs (not illustrated). By variation of the height $H_A$, the exit surface $A_A$ of the diffusor can be varied in a simple way and matched to the situation of use.

The parallelepipedal or cylindrical configuration of the contour of the diffusor 4 in the embodiment according to FIG. 14 is to be understood only as an example. The diffusor in axial section can have, for example, also the shape of an isosceles triangle whose symmetry axis is the ventilator axis 43. The walls of the diffusor are then also of different height and arranged such that the exit ends of these walls are positioned in the triangle sides. When the diffusor walls have a round contour, a conical contour of the diffusor then result spatially in axial section for an isosceles triangle. When the walls have an angular, approximately quadrangular contour, a corresponding angular or four-sided pyramid then results for the diffusor. The exit surface $A_A$ in such embodiments, as in the embodiment according to FIGS. 13 and 14, is significantly greater than the diffusor inlet surface $A_E$. The exit ends of the walls, as in the preceding embodiment, can be positioned at approximately 90° to the lateral surfaces as well as to the end face of the diffusor 4.

In the embodiments according to FIGS. 13 and 14, the diffusors can have walls with round and angular contour in combination.

A particularly advantageous embodiment of a diffusor is shown in FIG. 15. The diffusor 4 is embodied similar to the embodiment according to FIG. 10. The diffusor is joined to the nozzle 19 of the ventilator 3. The nozzle 19 has a circular contour. The ventilator 3 comprises the impeller 20 with hub 21 from which the vanes 22 are projecting at uniform spacings. They are advantageously provided at the radial outer rim with a winglet 23, respectively. The rearward edge 24 of the vanes 22, in rotational direction, is advantageously profiled, in particular with tooth-like profiles. The vanes 22 are also advantageously twisted.

Of course, the vanes 22 can also have any other suitable configuration.

The diffusor 4 can be joined with the nozzle 19 radially but also axially, as has been described with the aid of FIGS. 9 and 10.

The nozzle 19 is provided at the nozzle plate 32 that has approximately the same cross-section as the free end of the wall 8. The nozzle 19 and the nozzle plate 32 are advantageously monolithically configured with each other but can also be separate components which are fixedly attached to each other in a suitable way.

The nozzle plate 32 has advantageously the same angular contour as the outlet end of the wall 8. In this way, the ventilators with the diffusors 4 can be arranged tightly behind and/or adjacent to each other. The nozzle plates 32 and the walls 8 of the diffusors 4 of neighboring ventilators 3 can abut each other as illustrated in an exemplary fashion in FIG. 1. The outer wall 8 extends in axial section approximately concavely. The sides of the intermediate wall 9 extend in axial section approximately straight while the sides of the intermediate wall 10 have an approximately convex course in axial section.

In flow direction behind the impeller 20, the guide vanes 26 can be provided in the diffusor 4 which extend between the walls 8 to 10 and are rigidly arranged. The guide vanes 26 are located at the side of the attachment 25 by means of which the diffusor 8 is connected to the nozzle 19, which side is facing away from the vanes 22. The diffusor 4 is pushed with its interface onto or into the nozzle 19.

The walls 8 to 10 can be designed to be noise-dampened so that in use the ventilators produce only a quiet operating noise. The walls 8 to 10 can be designed to be adjustable so that, with respect to their contour shape, they can be matched to the flow conditions and/or mounting conditions at least over a portion of their height.

The intermediate wall 9 is comprised of two wall sections 9*a* and 9*b* that are slightly overlapping each other. The overlap area is designed such that a gap 47 is provided which leads to a positive fluid mechanical effect. A portion of the air that is flowing through the passage 11 passes through the gap 47 and therefore reaches the passage 12. Due to this gap 47, which is extending advantageously about the circumference of the intermediate wall 9, the boundary layer flow in the axial outwardly positioned passage 12 is accelerated by means of the energy-rich flow of the father inwardly positioned passage 11. In this way, flow separation in the father outwardly positioned passage 12 is prevented or at least delayed. In this way, the energy efficiency of the diffusor 4 is increased.

The overlap of the two wall sections 9*a*, 9*b* can be designed such that a portion of the air flows out of the inner into the outer passage or out of the outer into the inner passage.

The annular gap 47 can be interrupted by webs or the like, by means of which the two wall sections 9*a*, 9*b* in the overlap area are connected to each other. The diffusor can also be provided with appropriate gaps 47 at further locations.

FIG. 16 shows a diffusor 4 in which the intermediate wall 9 is provided with cutouts 48 or slots 49 by means of which a similar effect is achieved as with the gap 47 of the diffusor according to FIG. 15. With these cutouts or slots, an energy-rich fluid from a passage is transferred into the boundary layer of the neighboring passage in order to avoid, or at least reduce, boundary layer separation.

The cutouts 47 are advantageously distributed about the circumference of the intermediate wall 9.

The cutouts 48 and the slots 49 can also be provided in combination on the intermediate wall 9. These cutouts and slots can be provided at any of the walls of the diffusor 4 at any location and in any suitable distribution. This applies likewise to the gap 47 of the diffusor 4 according to FIG. 15.

In other respects, the diffusor 4 is of the same configuration as the embodiment of FIG. 2 so that reference is being had to the description of the diffusor provided there.

The invention claimed is:

1. A diffusor comprising:

a first wall defining an inlet having a round cross-section and further defining an outlet having an angular cross-section;

wherein the round cross-section, across a height of the first wall from the inlet to the outlet in a height direction, passes into the angular cross-section;

wherein the first wall has sides, wherein transitions between the sides of the first wall have a twist in the height direction, the twist following a swirl of a flow of air through the diffusor, wherein the transitions each have a length and are positioned across the length at an angle relative to a first radial line of the diffusor extending through a corner area of the outlet of the first wall where the transitions end, respectively.

2. The diffusor according to claim 1, wherein a cross-sectional surface of the diffusor first decreases and then increases in a direction away from the inlet and toward the outlet.

3. The diffusor according to claim 1, wherein the angular cross-section is provided across more than one fourth of the height of the first wall.

4. The diffusor according to claim 1, further comprising a second wall that is surrounded at a spacing by the first wall.

5. The diffusor according to claim 4, wherein the second wall has an angular cross-section at least at the outlet.

6. The diffusor according to claim 5, wherein an end of the second wall at the inlet has a round cross-section that passes continuously into an angular cross-section across a height of the second wall.

7. The diffusor according to claim 6, wherein the second wall has sides, wherein transitions between the sides of the second wall have a twist in the height direction.

8. The diffusor according to claim 1, wherein the twist of the transitions between the sides of the first wall fulfills the formula $\theta \times D/L$, wherein D is the diameter of an impeller of a ventilator to which the diffusor is attached and L is the axial length of the diffusor in the height direction, wherein $\theta$ is an angle measured between the first radial line and a second radial line, wherein, viewed in an axial direction of the diffusor, the second radial line extends through a point of intersection where the transitions and a free rim of the inlet of the first wall meet, respectively, wherein the twist is in a range between approximately 50° and approximately 100°.

9. The diffusor according to claim 1, further comprising a second wall, wherein the first wall surrounds the second wall and one or more passages are formed between the first and second walls, wherein outlet ends of the first and second walls are positioned at different heights in the height direction for enlarging an outlet surface of an outlet end of the diffusor.

10. The diffusor according to claim 9, wherein the outlet ends of the first and second walls are positioned in a curved surface such as a spherical surface or cylinder surface.

11. The diffusor according to claim 9, wherein the outlet ends of the first and second walls are positioned in planar surfaces that are lateral surface of an imaginary parallelepiped or an imaginary pyramid.

12. The diffusor according to claim 9, wherein at least one of the first and second walls comprises an opening through which the passages that are neighboring each other are in fluid communication with each other.

13. A ventilator comprising an impeller and further comprising a diffusor according to claim 1.

14. The ventilator according to claim 13, wherein the first wall at the outlet has rounded corners between the sides of the first wall, wherein the rounded corners have a radius that is in a range of approximately $<0.5 \times D$, wherein D is the diameter of the impeller.

15. The ventilator according to claim 14, wherein an exit surface $A_R$ of the first wall at the outlet with the rounded corners is smaller than an exit surface A of the first wall when no rounded corners are present between the sides of the first wall, wherein a ratio $A/A_R$ is in a range between approximately 1 and approximately 1.27.

16. A device comprising a ventilator according to claim 13.

17. The device according to claim 16, comprising a housing that has at least one sidewall with a top side on which several of said ventilator are arranged.

18. The device according to claim 17, wherein the diffusors of said ventilators have an angular outlet cross-section.

19. The device according to claim 18, wherein the diffusors that are neighboring each other are abutting each other with contour sides.

20. A diffusor comprising:

at least one first wall comprising an inlet and an outlet;

at least one second wall that is surrounded at a spacing by the at least one first wall and comprises an angular cross section at least at an outlet of the at least one second wall;

wherein the at least one first wall has sides, wherein transitions between the sides of the at least one first wall have a twist in the height direction, the twist following a swirl of a flow of air through the diffusor.

21. A diffusor comprising:

at least one first wall comprising an inlet and an outlet;

at least one second wall that is surrounded at a spacing by the at least one first wall, wherein the at least one second wall comprises a round cross section at an inlet of the at least one second wall and the round cross section passes continuously into an angular cross-section across a height of the at least one second wall;

wherein the at least one first wall has sides, wherein transitions between the sides of the at least one first wall have a twist in the height direction, the twist following a swirl of a flow of air through the diffusor.

22. A diffusor comprising:

at least one first wall comprising an inlet having a round cross-section and further comprising an outlet having an angular cross-section;

wherein the round cross-section, across a height of the at least one first wall from the inlet to the outlet, passes into the angular cross-section;

wherein the at least one first wall has sides, wherein first transitions between the sides of the at least one first wall have a twist across the height, the twist following a swirl of a flow of air through the diffusor, wherein the first transitions each have a first length and are positioned across the first length at a first angle relative to a first radial line of the diffusor extending through a corner area of the outlet of the first wall where the first transitions end, respectively;

at least one second wall that is surrounded at a spacing by the at least one first wall and comprises a round cross section at an inlet of the at least one second wall, wherein the round cross-section at the inlet of the at least one second wall passes continuously into an angular cross-section across a height of the at least one second wall;

wherein the at least one second wall has sides, wherein second transitions between the sides of the at least one second wall have a twist across the height of the at least one second wall, wherein the second transitions each have a second length and are positioned across the second length at an angle relative to a second radial line of the diffusor extending through a corner area of the outlet of the at least one second wall where the second transitions end, respectively.

23. A diffusor comprising:

at least one first wall comprising an inlet having a round cross-section and further comprising an outlet having an angular cross-section;

wherein the round cross-section, across a height of the at least one first wall from the inlet to the outlet, passes into the angular cross-section;

at least one second wall that is surrounded at a spacing by the at least one first wall and comprises a round cross section at an inlet of the at least one second wall, wherein the round cross-section at the inlet of the at least one second wall passes continuously into an angular cross-section across a height of the at least one second wall;

wherein the at least one second wall has sides, wherein transitions between the sides of the at least one second wall have a twist across the height of the at least one second wall, wherein the transitions each have a length and are positioned across the length at an angle relative to a radial line of the diffusor extending through a corner area of the outlet of the at least one second wall where the transitions end, respectively.

* * * * *